United States Patent [19]

Leemans et al.

[11] Patent Number: 4,902,346

[45] Date of Patent: Feb. 20, 1990

[54] FILLER FOR DISINTEGRATING PROJECTILE

[75] Inventors: Johan S. Leemans, Rosmalen, Netherlands; Heinz J. Dorweiler, Wegberg, Fed. Rep. of Germany

[73] Assignee: NWM de Kruithoorn B.V., Netherlands

[21] Appl. No.: 57,080

[22] Filed: Jun. 3, 1987

[30] Foreign Application Priority Data

Jun. 3, 1986 [DE] Fed. Rep. of Germany ..... 3618205

[51] Int. Cl.[4] ..... F42B 5/22

[52] U.S. Cl. ..... 75/251; 86/10

[58] Field of Search ..... 75/251, 252; 86/10; 102/507

[56] References Cited

U.S. PATENT DOCUMENTS 3,951,035 4/1976 Dautzenberg et al. ..... 75/0.5 B A

FOREIGN PATENT DOCUMENTS 1215028 4/1966 Fed. Rep. of Germany .
1246474 8/1967 Fed. Rep. of Germany .
1286703 1/1969 Fed. Rep. of Germany .
2160187 1/1973 Fed. Rep. of Germany .

*Primary Examiner*—L. Dewayne Rutledge
*Assistant Examiner*—David W. Schumaker
*Attorney, Agent, or Firm*—Spencer & Frank

[57] ABSTRACT

A filler for disintegrating projectiles for training ammunition composed essentially of a screened low carbon, unalloyed steel powder produced by atomizing a corresponding steel melt to form a steel powder, subsequently subjecting the powder to a reducing soft annealing treatment at a temperature of between about 900° and 1050° C., subjecting the annealed product to a comminuting (e.g., beating, impact and scrubbing) process followed by screening, wherein the comminuting process lasts longer than 60 minutes and the screened powder has a grain size below 0.315 mm, an uncompressed or apparent density of between 3.9 and about 4.6 $g \cdot cm^{-3}$, and is compressible in such a manner that the resulting density of a pressed body to be incorporated into the disintegrating projectile lies between about 6.5 and 7.15 $g/cm^3$.

2 Claims, No Drawings

FILLER FOR DISINTEGRATING PROJECTILE

BACKGROUND OF THE INVENTION

The present invention relates to a filler for disintegrating projectiles used for training purposes, and to a process of manufacturing the filler.

A filler of this type is disclosed in U.S. Pat. No. 3,951,035. This filler has been found quite satisfactory for the following reasons: it meets in a reliable manner the necessary primary safety conditions, defined basically as follows: a piece of paper weighing 200 g/m$^2$ in a frame placed 40 m in front of the muzzle of the gun barrel must not be perforated by any of the steel powder particles; it is economical in manufacture; and it meets the strict requirements for responsible environmental protection.

In view of the fact that recovery of the steel powder scattered during firing is impossible and the maneuver, or training, area is almost always utilized for agriculture and/or forestry, environmental protection is of major importance. This agricultural or forestry utilization is in no way interfered with since the steel powder is not only harmless but also compatible for animals turned out to pasture.

As far back as 1974, however, there have been reports of cases in which the filler material of disintegrating projectiles caused eye damage involving the danger of siderosis [deposits of iron pigment in eye tissue]. Demands were made at that time that the filler in disintegrating projectiles be replaced by the most inactive substance possible.

Many attempts have been made to meet these demands. However, no positive result has been attained because such demands cannot be viewed in isolation but only in conjunction with the other above-mentioned conditions. This was the reason that an intensive search was also made for other types of solutions.

SUMMARY OF THE INVENTION

It is now an object of the invention to provide a filler of the described type and a process of manufacturing it with which animal digestive compatibility of the powder particles is maintained but their spatial danger zone is considerably more limited and reduced in size.

The above and other objects are achieved, according to the invention, by a filler for disintegrating projectiles for training ammunition composed essentially of a low carbon, unalloyed steel powder produced by atomizing a corresponding steel melt to form a steel powder, subsequently subjecting the powder to a reducing soft annealing treatment at a temperature of between about 900° and 1050° C., subjecting the annealed product to a comminuting (i.e., a beating, impact and scrubbing) process followed by screening, wherein the comminuting process lasts longer than 60 minutes and the screened powder has a grain size fraction below 0.315 mm, an apparent or uncompressed density of between about 3.9 and 4.6 g/cm$^3$, and is compressible in such a manner that the resulting density of a pressed body to be incorporated into the disintegrating projectile lies between about 6.5 and 7.15 g/cm$^3$.

Accordingly, the safety distance to be maintained in front of the muzzle of a gun barrel during firing of training, or blank, ammunition in the form of disintegrating projectiles, when employing the steel powder according to the invention is reduced considerably, compared to prior art fillers, namely from 40 m to about 10 m.

This dramatic improvement is the more surprising since in the past it was thought that the presence of grains of a size less than 0.15 mm in such powder was damaging. Reference is made in this connection to German Pat. No. 1,282,866 in which the stated lower limit is justified by the statement that lower grain sizes would result in the pressed body produced from such powder having too high a green strength, with the result that the required disintegrating behavior of the pressed body produced from the iron powder would be impaired to the point where it is useless. The above cited U.S. Pat. No. 3,951,035, even states a lower grain size limit of 0.2 mm, preferably 0.4 mm.

Consequently, the present invention not only overcomes a clear prejudice in the art, but it also results in particular economy of manufacture; since in the prior art processes the screened out portion of grains below the acceptable limit could only be returned again to a melting assembly. According to the present invention, this grain size component in a range below 0.25 mm constitutes the desired and preferred grain size.

In corresponding prior art disintegrating projectiles, rotationally, or axially, symmetrical pressed bodies made of iron powder fill a plastic casing whose outer shape, due to the requirement for easy insertion of the cartridge, should substantially correspond to the shape of a live projectile. This requires that, in addition to the circularly cylindrical pressed body, a disintegrating projectile must include a further pressed body which is adapted to the ogival shape of the front region of the projectile. Additionally, loose iron powder is employed.

DESCRIPTION OF THE PREFERRED EMBODIMENTS

The steel powder and the pressed body according to the invention are produced in the following manner: a steel powder obtained by atomizing a corresponding steel melt and subsequently reducibly soft annealing, or spheroidizing at a temperature of between 900° and 1050° C. is subjected for at least one hour to a beating, impact and scrubbing treatment in a conventional hammer mill.

The prior art beating, impact and scrubbing treatments of steel powder in a hammer mill were usually effected for about 15 to 30 minutes.

The long duration of the beating, impact and scrubbing treatment of the steel powder according to the invention causes the individual powder grain surfaces to be compacted and smoothed in such a manner that, even after being charged with high compression pressures of, e.g. 820 MPa, the contact surfaces of these grains in the pressed body do not hook into one another, since there are no surface roughnesses via which the grains can attach to one another, or adhere to one another so that the pressed body or bodies of the disintegrating projectile lose their shape retention capability, sometimes already as a result of the centrifugal forces caused by the spin in the gun barrel. As a result such bodies are present as individual grains immediately after leaving the gun barrel when the plastic casing breaks open. The high friction produced by the air causes the grains to become ineffective and drop to the ground already on a path less than 10 m in front of the gun muzzle.

After the beating, impact and scrubbing treatment, the powder is sifted and the grain size fraction of less than 0.315 mm, preferably less than 0.25 mm, is selected.

From the screened out steel powder of the grain spectrum according to the invention, a plurality of, for example five, test or sample pressed bodies are produced which are subjected to a special drum test to determine whether the steel powder meets the requirements of the invention for use as filler and/or pressed body for disintegrating projectiles. The drum test for sample bodies having a diameter of 20 mm, a density of $7.15 \pm 0.02$ g/cm$^3$ and a weight of $32.5 \pm 0.1$ g is effected according to Steel-Iron Test Sheet 87-69, 1st Edition, December 1969, with a testing device modified in that the wall of the rotary drum is configured as a screen having a 1 mm mesh width. The requirement here is that all broken pieces of the sample body or bodies must have completely disintegrated and left the drum after 200 to 600 revolutions, preferably after 400 revolutions.

Sample bodies which disintegrate already after, for example, 50 revolutions, do not have sufficient handling strength; the danger exists that they abrade or fall apart already during manipulation. If the sample bodies have not yet disintegrated after, for example, 800 drum revolutions, they have too high a strength and the danger exist that when fired the disintegrating projectile will not disintegrate within 10 m after leaving the muzzle of the gun barrel and will perforate the paper target (weight 200 g/m$^2$). Such a steel powder would then have to be checked again in a practical test of sample firing to determine its usefulness. If the test conditions are met, the steel powder can be used as a filler and/or for the production of pressed bodies incorporated in disintegrating projectiles according to the invention.

A compression pressure in a range from 480 to 820 MPa, preferably 680 MPa, has here been found to be favorable for forming the pressed bodies. Due to the smooth surface of the individual powder grains, the required compression pressure is noticeably lower compared to the coarser steel powder used in the above cited U.S. patent so that less energy expenditures and less wear result for the pressing tools. The resulting density of the pressed body depends on its height and configuration and lies between 6.5 and 7.15 g/cm$^3$. Experience has shown that a more favorable result can be attained in a conventional hammer mill if it is operated for at least 60 minutes, and preferably 120 minutes.

To protect the press-mold employed, zinc stearate may be added to the steel powder as a pressing facilitating lubricant, with the quantity of this additive being in a range from about 0.3 to about 0.55%, preferably, however, 0.5%, by weight of the steel powder.

If necessary, a release agent may be added to the steel powder to be pressed, with or without the zinc stearate, before the powder is pressed. Flame soot is particularly suitable for this purpose. This substance prevents the compressed powder grains from sticking together, with small added quantities being sufficient.

An example of a screen analysis is given below for a steel powder extracted from the hammer mill after the beating, impact and scrubbing treatment:

| μm | >315 | >250 | >200 | >160 | >100 | >63 | <63 |
|---|---|---|---|---|---|---|---|
| weight % | 0 | 1.0 | 15.4 | 16.7 | 34.4 | 19.3 | 12.7 |

This steel powder had an apparent density of 4.36 g/cm$^3$. The screen analysis can be changed, for example, by modifying the steel melt atomizing parameters, the beating, impact and abrasion treatment or by intermediately screening out certain grain size portions so as to adapt the powder to attain particular characteristics for the intended purpose.

Due to its special consistency, including high compaction and smooth surface of the individual powder grains, uniform shape of the particles, positively set grain size distribution, high fill density, good compressibility and high chemical purity, the steel powder according to the present invention can not only be used as a loose filler, which can be shaken or poured into the case, but particularly also for the manufacture of pressed bodies for disintegrating projectiles of a caliber of 20 mm, and particularly also for larger calibers, preferably 35 mm or 40 mm.

The invention now being fully described, it will be apparent to one of ordinary skill in the art that many changes and modifications can be made thereto without departing from the spirit or scope of the invention as set forth herein.

What is claimed:

1. Filler for disintegrating projectiles for training ammunition composed essentially of a screened low carbon, unalloyed steel powder having been produced by atomizing a corresponding steel melt to form a steel powder, subsequently subjecting the powder to a reducing soft annealing treatment at a temperature of between about 900° and 1050° C., and subjecting the annealed product to a comminuting process followed by screening, wherein the comminuting process lasts longer than 60 minutes and said screened powder having a grain size below 0.315 mm, an uncompressed density of between 3.9 and about 4.6 g/cm$^3$, and being compressible in such a manner that the resulting density of a pressed body to be incorporated into the disintegrating projectile lies between about 6.5 and 7.15 g/cm$^3$.

2. Filler for disintegrating projectiles for training ammunition, said filler being composed essentially of unalloyed steel powder screened to a grain size of less than 0.315 mm, having an uncompressed density of about 3.9 to 4.6 g/cm$^3$, and being compressible into a body having a density of 6.5 to about 7.15 g/cm$^3$.

* * * * *

UNITED STATES PATENT AND TRADEMARK OFFICE

CERTIFICATE OF CORRECTION

PATENT NO. : 4,902,346

DATED : February 20, 1990

INVENTOR(S) : Johan S. Leemans and Heinz J. Dorweiler

It is certified that error appears in the above-identified patent and that said Letters Patent is hereby corrected as shown below:

Title page:
In the heading of the patent, under [73], please change the following:

after "NWM de Kruithoorn B.V." insert -- 's-Hertogenbosch --; and please add the following assignee --Mannesmann AG, Düsseldorf, Federal Republic of Germany--

Signed and Sealed this

Twenty-third Day of April, 1991

*Attest:*

*Attesting Officer*

HARRY F. MANBECK, JR.

*Commissioner of Patents and Trademarks*